US009631812B2

(12) United States Patent
Stoia et al.

(10) Patent No.: US 9,631,812 B2
(45) Date of Patent: Apr. 25, 2017

(54) SUPPORT FRAME AND METHOD FOR ASSEMBLY OF A COMBUSTION MODULE OF A GAS TURBINE

(71) Applicant: General Electric Company, Schenectady, NY (US)

(72) Inventors: Lucas John Stoia, Taylors, SC (US); Richard Martin DiCintio, Simpsonville, SC (US); William Michael Poschel, Greenville, SC (US); Patrick Benedict Melton, Horse Shoe, NC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 733 days.

(21) Appl. No.: 13/845,661

(22) Filed: Mar. 18, 2013

(65) Prior Publication Data

US 2014/0360193 A1 Dec. 11, 2014

(51) Int. Cl.

| | |
|---|---|
| ***F23R 3/60*** | (2006.01) |
| ***F23R 3/00*** | (2006.01) |
| *B25B 11/02* | (2006.01) |

(52) U.S. Cl.

CPC ..... *F23R 3/00* (2013.01); *B25B 11/02* (2013.01); *F23R 3/60* (2013.01);

(Continued)

(58) Field of Classification Search

CPC .. F23R 2900/00017; F23R 2900/00019; F23R 3/60; F23R 3/28; F02C 7/20; B25B 11/02

(Continued)

(56) References Cited

U.S. PATENT DOCUMENTS

| | | | |
|---|---|---|---|
| 3,872,664 | A | 3/1975 | Lohmann |
| 4,265,615 | A | 5/1981 | Lohmann |

(Continued)

FOREIGN PATENT DOCUMENTS

| | | | |
|---|---|---|---|
| DE | EP 2236939 A1 * | 10/2010 | ..... F23R 3/60 |
| EP | 0526058 A1 | 3/1993 | |

(Continued)

OTHER PUBLICATIONS

English Translation of Patent EP2236939A1 provided by google patents.*

(Continued)

*Primary Examiner* — Gerald L Sung
*Assistant Examiner* — Thomas Burke
(74) *Attorney, Agent, or Firm* — Dority & Manning, PA

(57) ABSTRACT

A support frame for assembling a combustion module for a gas turbine includes a base plate disposed at a bottom end of the support frame and a support plate that is vertically separated from the base plate by one or more vertical support members. The support plate defines an opening that is sized to allow a portion of the combustion module to pass therethrough. A support block extends vertically from the base plate towards the support plate where the support block defines one or more fastener holes for connecting an aft end of a combustion liner of the combustion module to the support block. A central support column extends vertically from the base plate towards the support plate. A horizontal support extends radially outward from the central support column to align the combustion liner with the opening in the support plate.

15 Claims, 12 Drawing Sheets

(52) U.S. Cl.
CPC ..... *F23R 2900/00017* (2013.01); *F23R 2900/00019* (2013.01); *Y10T 29/4932* (2015.01); *Y10T 29/53961* (2015.01)

(58) Field of Classification Search
USPC ..... 269/37, 289 R, 291; 29/281.1; 60/798, 60/796
See application file for complete search history.

(56) References Cited

U.S. PATENT DOCUMENTS 4,420,929 A 12/1983 Jorgensen
5,069,029 A 12/1991 Kuroda
5,380,154 A 1/1995 Norton
5,415,000 A * 5/1995 Mumford ..... F23R 3/60 60/740
5,450,725 A 9/1995 Takahara
5,475,979 A 12/1995 Oag
5,802,854 A 9/1998 Maeda
6,047,550 A 4/2000 Beebe
6,148,604 A 11/2000 Salt
6,212,870 B1 4/2001 Thompson et al.
6,374,594 B1 4/2002 Kraft et al.
6,442,946 B1 9/2002 Kraft
6,450,762 B1 9/2002 Munshi
6,543,993 B2 4/2003 Burdgick et al.
6,654,710 B1 11/2003 Keller
6,875,009 B2 4/2005 Kayahara et al.
6,896,509 B2 5/2005 Carroni et al.
6,957,949 B2 10/2005 Hyde et al.
7,082,766 B1 8/2006 Widener et al.
7,743,612 B2 6/2010 Morenko
8,096,131 B2 1/2012 Ziaei et al.
8,158,428 B1 * 4/2012 Krishna ..... G01N 25/72 250/339.14
8,171,738 B2 5/2012 Fish et al.
8,540,204 B2 * 9/2013 Hernandez ..... B66C 23/04 248/555
2002/0184893 A1 12/2002 Farmer
2003/0039542 A1 2/2003 Cromer
2005/0044855 A1 3/2005 Crawley
2005/0076490 A1 * 4/2005 Kemsley ..... B23Q 3/186 29/464
2005/0241317 A1 11/2005 Martling
2005/0268617 A1 12/2005 Amond
2008/0282667 A1 11/2008 Intile
2009/0071157 A1 3/2009 Cai
2009/0199561 A1 8/2009 Hessler
2010/0038835 A1 * 2/2010 Horiuchi ..... F01D 25/285 269/47
2010/0054928 A1 3/2010 Schiavo
2010/0071377 A1 3/2010 Fox
2010/0139283 A1 6/2010 Phillips et al.
2010/0170216 A1 * 7/2010 Venkataraman ..... F02C 7/22 60/39.37
2010/0174466 A1 7/2010 Davis, Jr. et al.
2010/0263386 A1 10/2010 Edwards
2010/0307000 A1 * 12/2010 Herbold ..... F23R 3/60 29/888
2011/0067402 A1 3/2011 Wiebe
2011/0146284 A1 6/2011 Morimoto
2011/0239652 A1 * 10/2011 McMahan ..... F23R 3/34 60/737
2011/0247314 A1 10/2011 Chila
2011/0304104 A1 12/2011 McMahan
2012/0186260 A1 7/2012 DiCintio et al.
2012/0210729 A1 8/2012 Cihlar et al.
2012/0304648 A1 12/2012 Byrne
2014/0033728 A1 2/2014 Marmilic
2014/0123656 A1 * 5/2014 Sancewich ..... F01D 9/026 60/752
2014/0260272 A1 9/2014 DiCintio
2015/0147151 A1 * 5/2015 Mogle, II ..... B25B 11/02 414/800

FOREIGN PATENT DOCUMENTS

EP 0578461 A1 12/1994
EP 1884297 A1 2/2008
WO EP 2743458 A2 * 6/2014 ..... F01D 9/023

OTHER PUBLICATIONS

Co-Pending U.S. Appl. No. 13/845,439, dated Mar. 18, 2013.
Co-Pending U.S. Appl. No. 13/845,365, dated Mar. 18, 2013.
Co-Pending U.S. Appl. No. 13/845,485, dated Mar. 18, 2013.
Co-Pending U.S. Appl. No. 13/845,565, dated Mar. 18, 2013.
Co-Pending U.S. Appl. No. 13/845,617, dated Mar. 18, 2013.
Co-Pending U.S. Appl. No. 13/845,699, dated Mar. 18, 2013.
Co-Pending U.S. Appl. No. 13/845,378, dated Mar. 18, 2013.
Co-Pending U.S. Appl. No. 13/845,384, dated Mar. 18, 2013.

* cited by examiner

SUPPORT FRAME AND METHOD FOR ASSEMBLY OF A COMBUSTION MODULE OF A GAS TURBINE

FIELD OF THE INVENTION

The present invention generally involves a combustor for a gas turbine. More specifically, the invention relates to a support frame for the combustion module to allow for assembly of the combustion module prior to installation into the gas turbine.

BACKGROUND OF THE INVENTION

A typical gas turbine that is used to generate electrical power includes an axial compressor, one or more combustors downstream from the compressor, and a turbine that is downstream from the combustors. Ambient air is supplied to the compressor, and rotating blades and stationary vanes in the compressor progressively impart kinetic energy to the working fluid (air) to produce a compressed working fluid at a highly energized state. The compressed working fluid exits the compressor and flows towards a head end of combustor where it reverses direction at an end cover and flows through the one or more fuel nozzles into a primary combustion zone that is defined within a combustion chamber in each combustor. The compressed working fluid mixes with fuel in the one or more fuel nozzles and/or within the combustion chamber and ignites to generate combustion gases having a high temperature and pressure. The combustion gases expand in the turbine to produce work. For example, expansion of the combustion gases in the turbine may rotate a shaft connected to a generator to produce electricity.

A typical combustor includes an end cover that is coupled to a first outer casing such as a compressor discharge casing, at least one axially extending fuel nozzle that extends downstream from the end cover, and an annular cap assembly that extends radially and axially within the compressor discharge casing. Some combustor designs may include a forward case disposed between the end cover and the compressor discharge casing. A particular combustor includes a combustion module for providing late lean fuel injection to the combustor. The combustion module generally includes a fuel distribution manifold that circumferentially surrounds at least a portion of the cap assembly, and a fuel injection assembly that extends downstream from the fuel distribution manifold and that terminates at a point that is upstream from a first stage of stationary nozzles. When mounted within the combustor, a forward end of the fuel distribution manifold is coupled to the first outer casing.

The fuel injection assembly generally includes a combustion liner, a flow sleeve that circumferentially surrounds at least a portion of the combustion liner, an aft frame that is disposed at an aft end of the fuel injection assembly, and a plurality of fuel injectors that extend through the flow sleeve and the combustion liner. When mounted within the combustor, the aft frame is connected to a second outer casing such as an outer turbine casing and/or to a turbine nozzle retaining ring. A plurality of fluid conduits provide for fluid communication between the fuel distribution manifold and each of the plurality of fuel injectors. One end of each fluid conduit is connected to the fuel distribution manifold and a second end of each fluid conduit is connected to a corresponding one of the plurality of fuel injectors.

Assembly of the combustion module in situ on the gas turbine is challenging for various reasons. For example, limited access to the combustion module in situ on the gas turbine, in particular access to the connections between the fluid conduits and the fuel distribution manifold and/or the fuel injector, can make assembly difficult. In addition, the limited access generally restricts a technician's ability to visually inspect the connection between each fluid conduit and the fuel distribution manifold and/or the fuel injector, thereby resulting in increased man hours to complete the inspection. Therefore, a support frame which allows for assembly and testing of the combustion module prior to installation into the gas turbine would be useful.

BRIEF DESCRIPTION OF THE INVENTION

Aspects and advantages of the invention are set forth below in the following description, or may be obvious from the description, or may be learned through practice of the invention.

One embodiment of the present invention is a support frame for assembling a combustion module for a gas turbine. The support frame generally includes a base plate that is disposed at a bottom end of the support frame and a support plate that is vertically separated from the base plate by one or more vertical support members. The support plate defines an opening that is sized to allow a portion of the combustion module to pass therethrough. A support block extends vertically from the base plate towards the support plate where the support block defines one or more fastener holes for connecting an aft end of a combustion liner of the combustion module to the support block. A central support column extends vertically from the base plate towards the support plate. A horizontal support extends radially outward from the central support column to align the combustion liner with the opening in the support plate.

Another embodiment of the present invention is a combustion module for a gas turbine. The combustion module includes an annular fuel distribution manifold having a forward end axially separated from an aft end and a radially extending mounting flange that circumferentially surrounds the forward end. A fuel injection assembly extends downstream from the fuel distribution manifold. The fuel injection assembly includes a forward end axially separated from an aft end, an combustion liner that extends between the forward end and the aft end, a flow sleeve that circumferentially surrounds a portion of the combustion liner, a fuel injector that extends radially through the flow sleeve and the combustion liner, a fluid conduit that extends between the fuel injector and the fuel distribution manifold and an aft frame disposed at the aft end of the fuel injection assembly. The combustion module further includes a support frame. The support frame includes a base plate, a support plate, a vertical support member that extends between the base plate and the support plate and a support block that extends vertically from the base plate towards the support plate. The support plate defines an opening that extends vertically through the support plate. The fuel distribution manifold extends through the opening of the support plate. The mounting flange is in contact with the support plate, and the aft frame is connected to the support block.

The present invention may also include a method for assembling a combustion module within a support frame. The method comprises positioning an combustion liner of the combustion module over a central support column of the support frame and fastening an aft end of the combustion liner to a support block of the support frame. An annular flow sleeve is installed around a portion of the combustion liner and a plurality of fasteners are inserted through a plurality of anchor passages disposed proximate to a forward end of the combustion liner. An annular fuel distribution manifold is inserted through an opening in a support plate of the support frame such that an aft end of the fuel distribution manifold circumferentially surrounds a forward portion of the flow sleeve assembly. A mounting flange of the fuel distribution manifold is connected to the support plate. A module support plate is connected to the combustion liner and to the fuel distribution manifold using the plurality of fasteners to connect the combustion liner to the module support plate and a plurality of fasteners to connect the fuel distribution manifold to the module coupling plate.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
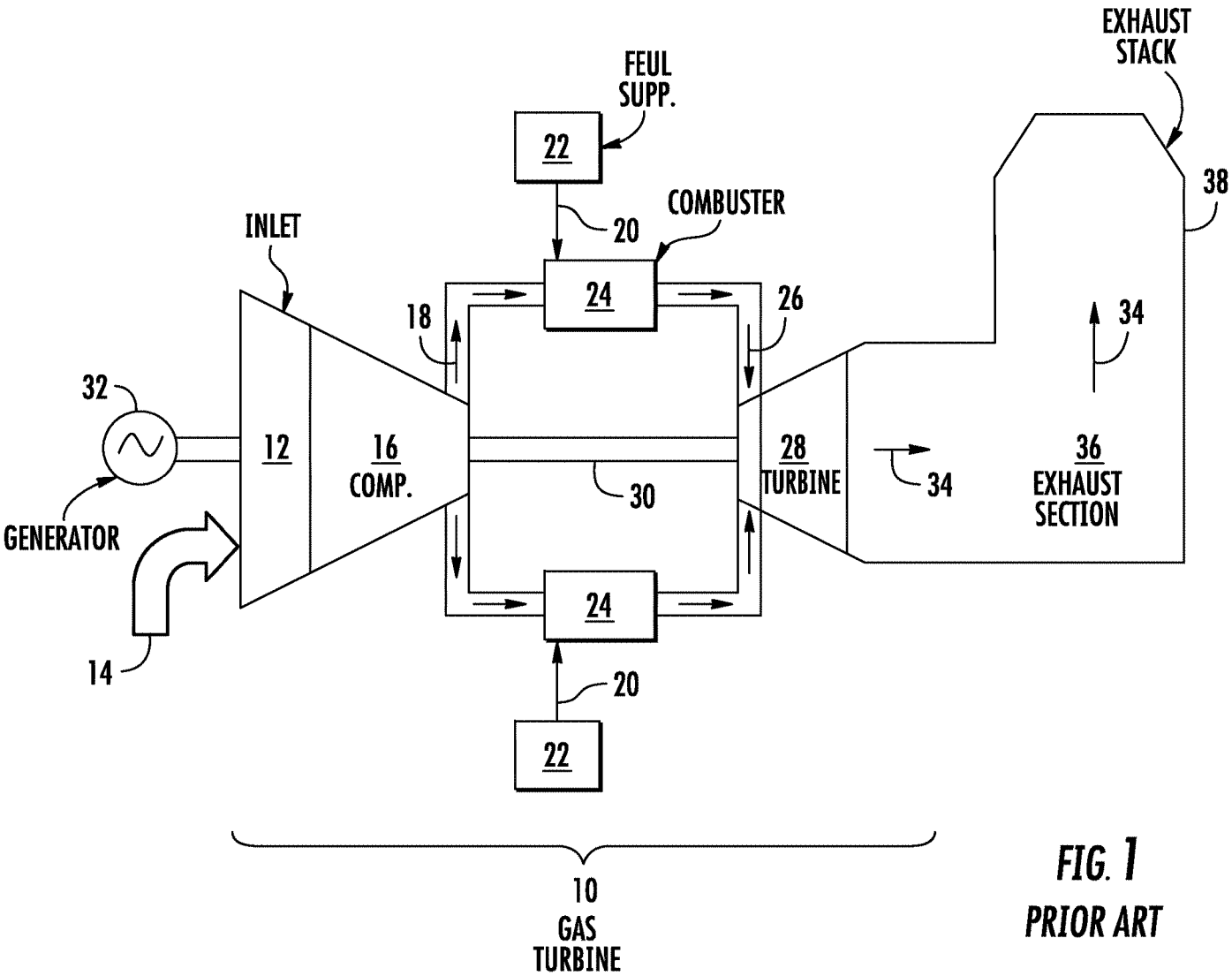
FIG. 1 PRIOR ART
FIG. 1 is a functional block diagram of an exemplary gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel to an axial centerline of a particular component.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although exemplary embodiments of the present invention will be described generally in the context of a combustor incorporated into a gas turbine for purposes of illustration, one of ordinary skill in the art will readily appreciate that embodiments of the present invention may be applied to any combustor incorporated into any turbomachine and is not limited to a gas turbine combustor unless specifically recited in the claims.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor section where a compressor 16 progressively imparts kinetic energy to the working fluid 14 to produce a compressed working fluid 18 at a highly energized state.

The compressed working fluid 18 is mixed with a fuel 20 from a fuel supply 22 to form a combustible mixture within one or more combustors 24. The combustible mixture is burned to produce combustion gases 26 having a high temperature and pressure. The combustion gases 26 flow through a turbine 28 of a turbine section to produce work. For example, the turbine 28 may be connected to a shaft 30 so that rotation of the turbine 28 drives the compressor 16 to produce the compressed working fluid 18. Alternately or in addition, the shaft 30 may connect the turbine 28 to a generator 32 for producing electricity. Exhaust gases 34 from the turbine 28 flow through an exhaust section 36 that connects the turbine 28 to an exhaust stack 38 downstream from the turbine 28. The exhaust section 36 may include, for example, a heat recovery steam generator (not shown) for cleaning and extracting additional heat from the exhaust gases 34 prior to release to the environment.

Figure 2:
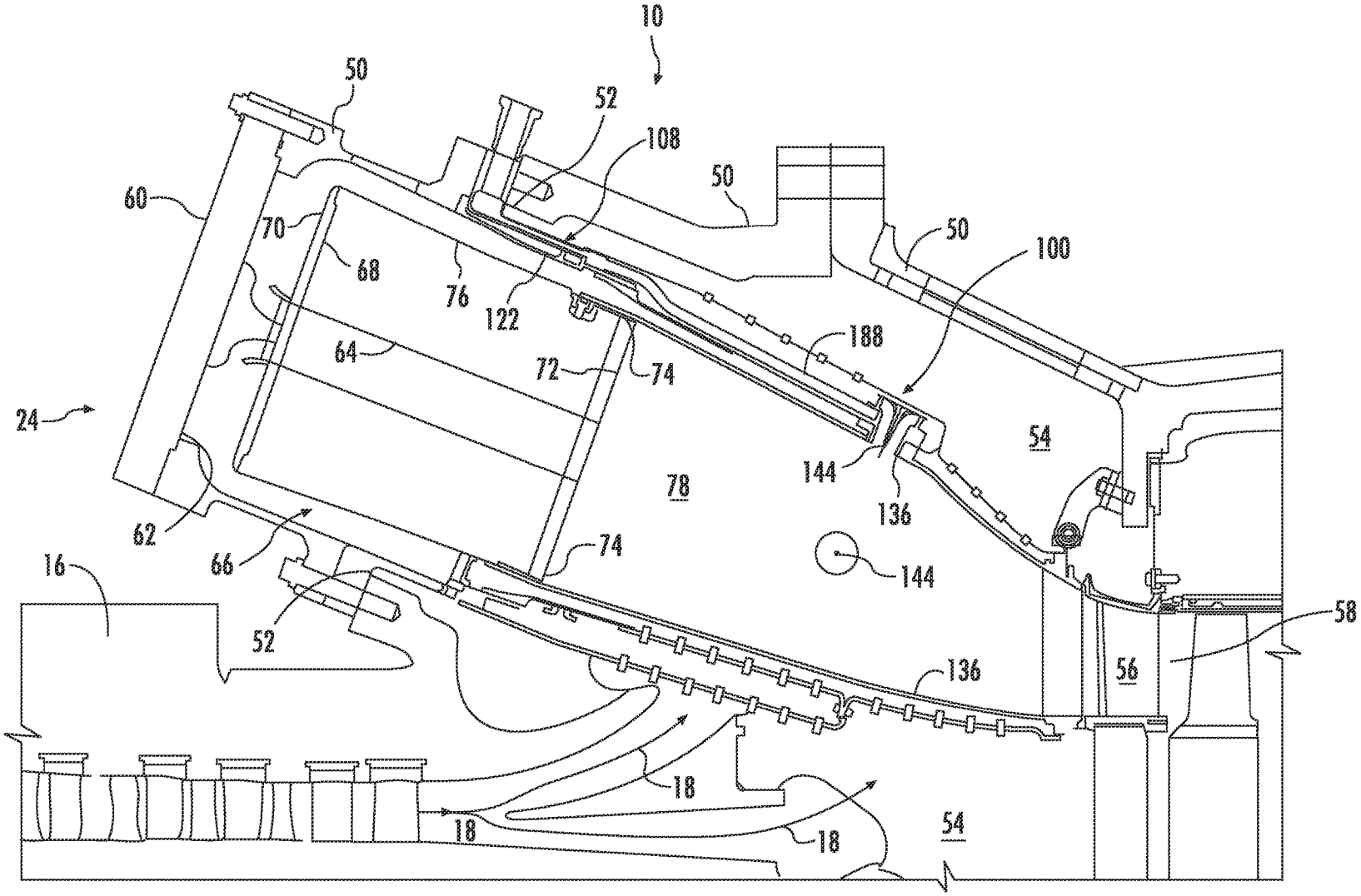
FIG. 2 is a cross-section side view of a portion of an exemplary gas turbine according to various embodiments of the present invention.

FIG. 2 provides a cross-section side view of a portion of the gas turbine 10 according to various embodiments of the present invention. As shown in FIG. 2, the gas turbine 10 generally includes an outer casing 50 that at least partially surrounds the combustor 24. The outer casing 50 at least partially defines an opening 52 for installing and/or supporting the combustor 24. The outer casing 50 at least partially defines a high pressure plenum 54 that at least partially surrounds at least a portion of the combustor 24. The high pressure plenum 54 is in fluid communication with the compressor 16. The gas turbine 10 further includes a first stage of stationary nozzles 56 at least partially disposed within the high pressure plenum 54. The first stage of stationary nozzles 56 at least partially defines an inlet 58 to the turbine 28.

As shown in FIG. 2, the combustor 24 generally includes a radially extending end cover 60 that is coupled to the outer casing 50 at one end of the combustor 24. The end cover 60 is generally in fluid communication with the fuel supply 22 (FIG. 1). As shown in FIG. 2, the end cover 60 includes an inner surface 62. At least one axially extending fuel nozzle 64 extends downstream from the inner surface 62 within the outer casing 50. An annular cap assembly 66 extends radially and axially within a portion of the outer casing 50. The cap assembly 66 is disposed generally downstream from the end cover 60.

The cap assembly 66 generally includes a radially extending base plate 68 disposed at a forward or upstream end 70 of the cap assembly 66, a radially extending cap plate 72 disposed at an aft or downstream end 74 of the cap assembly 66, and one or more shrouds 76 that extend at least partially between the base plate 68 and the cap plate 72. The axially extending fuel nozzle(s) 64 extends at least partially through the cap assembly 66 to provide fluid communication between the end cover 60 and/or the fuel supply 22 (FIG. 1) and a combustion chamber 78 that is defined downstream from the cap plate 72.

As shown in FIG. 2, a combustion module 100 extends through the opening 52 in the outer casing 50. At least a portion of the combustion module 100 circumferentially surrounds at least a portion of the cap assembly 66. When installed into the combustor 24, the combustion module 100 generally terminates upstream from and/or adjacent to the first stage of stationary nozzles 56.

Figure 3:
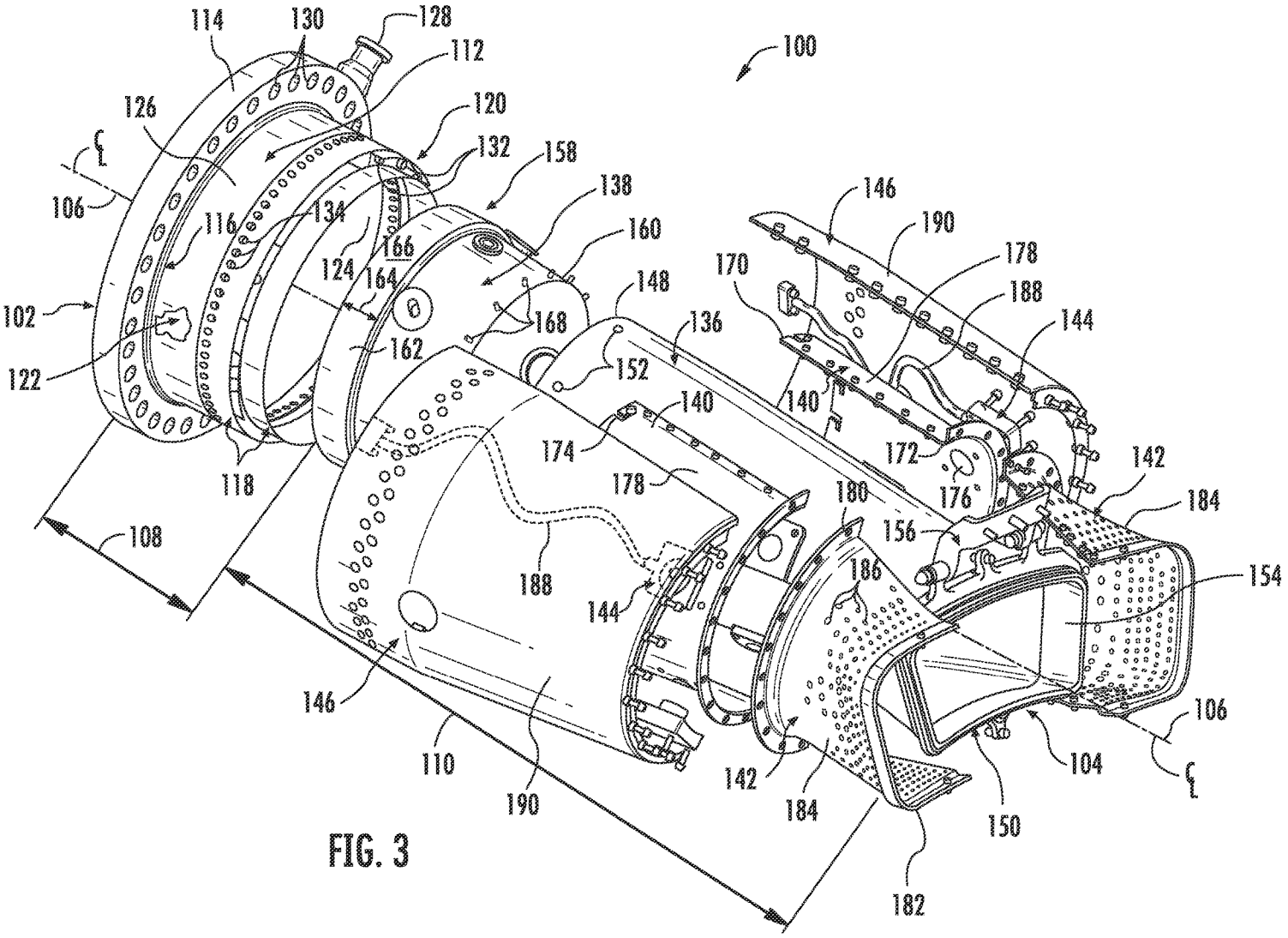
FIG. 3 is an exploded perspective view of a combustion module as shown in FIG. 2, according to at least one embodiment of the present invention.

FIG. 3 provides an exploded perspective view of the combustion module 100 as shown in FIG. 2 according to various embodiments of the present disclosure. In one embodiment, as shown in FIG. 3, the combustion module 100 has a forward or upstream end 102 that is axially separated from an aft or downstream end 104 with respect to an axial centerline 106 of the combustion module 100. The combustion module 100 comprises of an annular fuel distribution manifold 108 and a fuel injection assembly 110 that extends downstream from the fuel distribution manifold 108. The fuel distribution manifold 108 extends from the forward end 102 of the combustion module 100 towards the aft end 104 of the combustion module 100. The fuel injection assembly 110 extends between the fuel distribution manifold 108 and terminates at the aft end 104 of the combustion module 100.

In particular embodiments, the fuel distribution manifold 110 generally includes an annular main body 112, a radially extending mounting flange 114 that circumferentially surrounds a forward end 116 of the fuel distribution manifold 108, and an annular support ring 118 that extends radially and circumferentially around an aft end 120 of the fuel distribution manifold 108. The main body 112 defines a fuel plenum 122 disposed between an inner side 124 and an outer side 126 of the main body 112. The mounting flange 114 may include at least one fuel inlet port 128. The fuel inlet port 128 provides for fluid communication between the fuel supply 22 (FIG. 1) and the fuel plenum 122. The mounting flange 128 further includes a plurality of axially extending fastener holes 130 that are arranged circumferentially around the mounting flange 128. One or more fuel connector ports 132 are disposed generally adjacent to the aft end 120 of the fuel distribution manifold 108. The fuel connector ports 132 provide for fluid communication out of the fuel plenum 122. The support ring 118 includes a plurality of air injection passages 134 that are arranged circumferentially around the support ring 118. The air injection passages 134 may be circular, slotted or have any shape that allows for passage through the support ring 118. The support ring 118 may at least partially define the inner side 124 and the outer side 126 of the fuel distribution manifold 108.

In particular embodiments, the fuel injection assembly 110 comprises of an combustion liner 136 that extends axially along the axial centerline 106 of the combustion module 100, an annular support sleeve 138 that circumferentially surrounds a portion of the combustion liner 136, an annular flow sleeve 140 that circumferentially surrounds a portion of the combustion liner 136, an annular impingement sleeve 142 that circumferentially surrounds a portion of the combustion liner 136, and at least one fuel injector 144 that extends generally radially through the flow sleeve 140 and the combustion liner 136. In one embodiment, the fuel injection assembly further includes an outer flow sleeve or air shield 146 that at least partially circumferentially surrounds the flow sleeve 140 and/or the fuel injector(s) 144.

The combustion liner 136 includes a forward end 148 and an aft end 150. In particular embodiments, a plurality of radially extending anchor passages 152 extend through the combustion liner 136 proximate to the forward end 148. The anchor passages 152 are arranged circumferentially around the combustion liner 136. In particular embodiments, an aft frame 154 extends circumferentially around the aft end 150 of the combustion liner 136. The aft frame 154 may be coupled to the aft end 150 of the combustion liner 136 by any mechanical means suitable for the operating environment of the combustor 24 such as mechanical fasteners and/or welding. In the alternative, the combustion liner 136 and the aft frame 154 may be cast as a singular component. As shown in FIG. 3, a mounting bracket 156 may be coupled to the aft frame 154. The mounting bracket 156 may pivot in a forward direction and/or aft direction.

The support sleeve 138 generally includes a forward portion 158 that is axially separated from an aft portion 160. In particular embodiments, the support sleeve 140 includes a radially extending flange 162 that extends circumferentially around the forward portion 158 of the support sleeve 138. The flange 162 has an axial length 164 with respect to the axial centerline 106. The flange 162 defines an outer engagement surface 166 that extends at least partially across the axial length 164 of the flange 162. In particular embodiments, a plurality of fastening features 168 such as bolts, tabs, pins or bosses extend radially outward from and/or through the support sleeve 138 generally adjacent to the aft portion 160 of the support sleeve 138.

The flow sleeve 140 generally includes a forward end 170 that is axially separated from an aft end 172. A plurality of locking channels or slots 174 are disposed generally adjacent to the forward end 170 of the flow sleeve 140. In particular embodiments, the flow sleeve 140 and or the combustion liner 136 may at least partially define a fuel injector passage 176. In particular embodiments, the flow sleeve 140 comprises two or more semi-annular flow sleeve sections 178. The two or more semi-annular flow sleeve sections 178 may be joined together by any mechanical means suitable for the operating environment of the combustor 24 such as mechanical fasteners and/or welding.

The impingement sleeve 142 extends axially from the aft end 172 of the flow sleeve 140 towards the aft end 104 of the combustion module 100. The impingement sleeve 142 generally includes a forward end 180 that is axially separated from an aft end 182. In particular embodiments, the impingement sleeve 142 is formed from two or more semi-annular impingement sleeve sections 184 that are joined together by any mechanical means suitable for the operating environment of the combustor 24 such as mechanical fasteners and/or welding. The impingement sleeve 142 generally includes a plurality of cooling holes 186 that provide for fluid communication through the impingement sleeve 142. In particular embodiments, the support sleeve 138, the flow sleeve 140 and the impingement sleeve 142 are provided as a flow sleeve assembly.

As shown in FIG. 2, each of the at least one fuel injector(s) 144 extends at least partially through the combustor liner 136 downstream from the cap assembly 66. As shown in FIGS. 2 and 3, a fluid conduit 188 extends between each of the one or more fuel injector(s) 144 and the fuel distribution manifold 108 to provide for fluid communication between the fuel plenum 122 (FIG. 3) and the fuel injector(s) 144.

In particular embodiments, the outer flow sleeve or air shield 146 circumferentially surrounds at least a portion of the flow sleeve 140. In one embodiment, the outer flow sleeve 146 is formed from two or more semi-annular air shield sections 190. The outer flow sleeve 146 may at least partially surround each or some of the one or more fuel injector(s) 144. The two or more semi-annular air shield sections 190 may be joined together by any mechanical means suitable for the operating environment of the combustor 24 such as mechanical fasteners and/or welding. The combustion module 100 may include each or some of the components listed in the disclosure configured in the manner described herein, or may include similar components which preform the same function and that are configured in a different manner. For example, the combustion module 100 may include a continuous flow sleeve (not shown) that combines the impingement sleeve 142 and the flow sleeve 140 into a continuous component and replaces those individual components.

Figure 4:
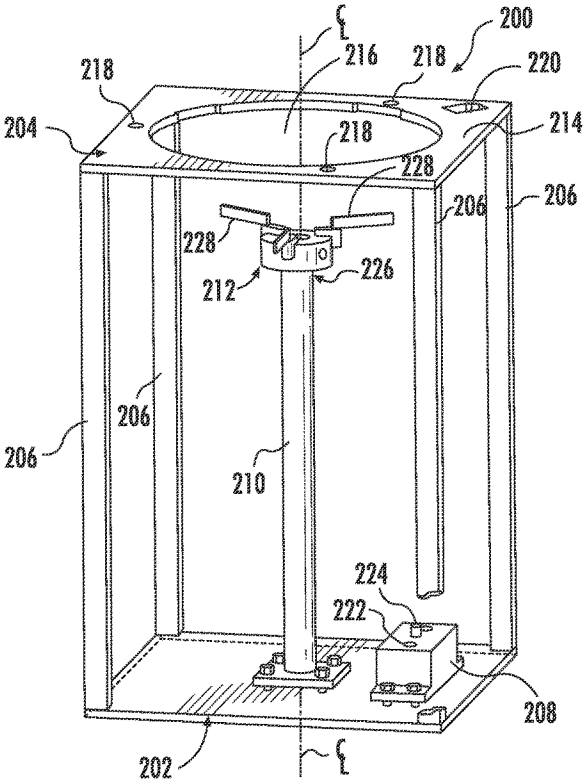
FIG. 4 is a perspective view of a support frame for assembling the combustion module shown in FIG. 3, according to at least one embodiment of the present invention.

FIG. 4 provides a perspective view of a support frame 200 for assembling the combustion module 100 (FIG. 3) off of the gas turbine 10 prior to installation into the combustor 24 according to various embodiments of the present disclosure. The support frame 200 may also be used for transporting and/or storing the combustion module 100. In particular embodiments, as shown in FIG. 4, the support frame 200 comprises a base plate 202, a support plate 204 that is vertically separated from the base plate 202, one or more vertical support members 206 that extend between the base plate 202 and the support plate 204, a support block 208 that extends vertically from the base plate 202 towards the support plate 204, a central support column 210 that extends vertically from the base plate 202 towards the support plate 204 and a horizontal support 212 that extends radially outward from the central support column 210. As used herein, the term "horizontal" refers to a direction that extends through a plane that is substantially parallel to a top surface 214 of the support plate 204 and the term "vertical" refers to a direction that extends through a plane that is substantially perpendicular to the top surface 214 of the support plate 204.

As shown in FIG. 4, the base plate 202 may be rectangular. However, it should be obvious to one or ordinary skill in the art that the base plate 202 may be circular or at least partially circular to reduce an overall footprint of the support frame 200. The base plate 202 may be manufactured from any material suitable to support the combustion module 100 during assembly, storage and transportation. For example, the base plate 202 may be constructed from steel, an alloy, a composite material or a plastic.

In particular embodiments, the support plate 204 at least partially defines an opening 216 that extends generally vertically through the support plate 204. In particular embodiments, the opening 216 is sized to allow at least a portion of the combustion module 100 (FIG. 3) to pass therethrough. In a particular embodiment, the opening 216 is sized to allow the assembled fuel injection assembly 110 (FIG. 3) to pass through the opening 216. As shown in FIG. 4, the support plate 204 may further include at least one fastener hole(s) 218 that extends generally vertically through the support plate 204. In particular embodiments, the fastener hole(s) 218 are arranged in an annular array around the opening 216 so as to align with at least some of the plurality of fastener openings 130 (FIG. 3) in the mounting flange 114

(FIG. 3). As shown in FIG. 4, the support plate 204 may further include an inlet port recess or cut-away 220. The inlet port recess 220 allows the fuel inlet port 128 (FIG. 3) of the fuel distribution manifold 108 (FIG. 3) to extend at least partially through the support plate 204, thereby providing clearance between the support plate 204 and the fuel inlet port 128 during assembly of the combustion module 100. In addition, the clearance may provide for connection of the inlet port to a compressed air/gas source (not shown) so that leak checks may be performed.

As shown in FIG. 4, the vertical support members 206 may be disposed proximate to the outer edges of the base plate 202 and/or the support plate 204. The vertical support members 206 may be generally rectangular, circular or have any cross-sectional shape that is suitable to support the combustion module 100 during assembly, storage and/or transport. In particular embodiments, the vertical support members 206 are of a sufficient vertical length so as to provide vertical separation between the horizontal support 212 and the support plate 204.

Figure 5:
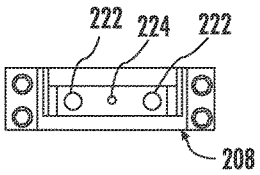
FIG. 5 is a top view of a portion of the support frame as shown in FIG. 4, according to at least one embodiment of the present invention.

FIG. 5 provides a top view of the support block 208 as shown in FIG. 4. In particular embodiments, as shown in FIGS. 4 and 5, the support block 208 is configured to support the aft end 150 of the combustion liner 136. For example, in one embodiment the support block 208 at least partially defines one or more fastener holes 222 for connecting the aft frame 154 (FIG. 3) of the combustion liner 136 (FIG. 3) to the support block 208. In particular embodiments, the support block 208 includes an alignment feature 224 such as a guide pin or guide pin hole for aligning the aft frame 154 (FIG. 3), in particular for aligning the mounting bracket 156 (FIG. 3) of the aft frame 154 with the support block 208. As shown in FIG. 4, the support block 208 may be fixed to the base plate 202 by any suitable means known in the art. For example, the support block 208 may be welded and/or bolted to the base plate 202.

As shown in FIG. 4, the central support column 210 is generally fixed at one end to the base plate 202. In one embodiment, the central support column 210 is coaxially aligned with the opening 216 of the support plate 204 with respect to an axial centerline of the opening 216. The central support column 210 may be fixed to the base plate 202 by any suitable means known in the art. For example, the central support column 210 may be welded and/or bolted to the base plate 202. The central support column 210 may be generally rectangular, circular or have any cross-sectional shape that is suitable to support the combustion module 100 during assembly, storage and/or transport. In particular embodiments, the central support column 210 is of a sufficient vertical length so as to provide vertical separation between a top portion 226 of the central support column 210 and the support plate 204.

Figure 6:
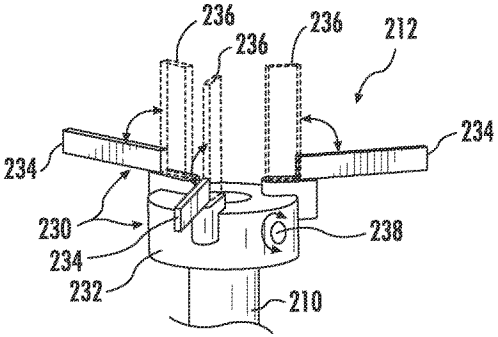
FIG. 6 is a perspective view of a portion of the support frame as shown in FIG. 4, according to at least one embodiment of the present invention.

As shown in FIG. 4, the horizontal support 212 generally includes a plurality of support arms 228 that extends radially outward from the central support column 210. The horizontal support 212 may be attached to and/or removed from the central support column 210. FIG. 6 provides a perspective view of the horizontal support 212 according to one embodiment of the present disclosure. As shown in FIG. 6, the horizontal support 212 may comprise a hub and spoke assembly 230. The hub and spoke assembly 230 generally comprises a hub or main body 232 and a plurality of retractable spokes or support arms 234. The hub 232 may be mounted to the central support column 210. In particular embodiments, the retractable spokes 234 are configured to rotate between a fully extended position as illustrated and a fully retracted position as illustrated by dashed lines 236. The retractable spokes 234 may be actuated at any point between the fully retracted position and the fully extended position by engaging or turning an actuator interface 238. In particular embodiments, the retractable spokes 234 may be removed from the hub 232. The actuator interface may include a screw, a bolt or a gear that may be turned or otherwise manipulated to actuate the retractable spokes 234. In an alternate embodiment, the horizontal support 212 may include a circular plate (not shown) or a plurality of semi-circular plates (not shown) that are coupled to the central support column 210 and that extend radially outward therefrom.

Figure 22:
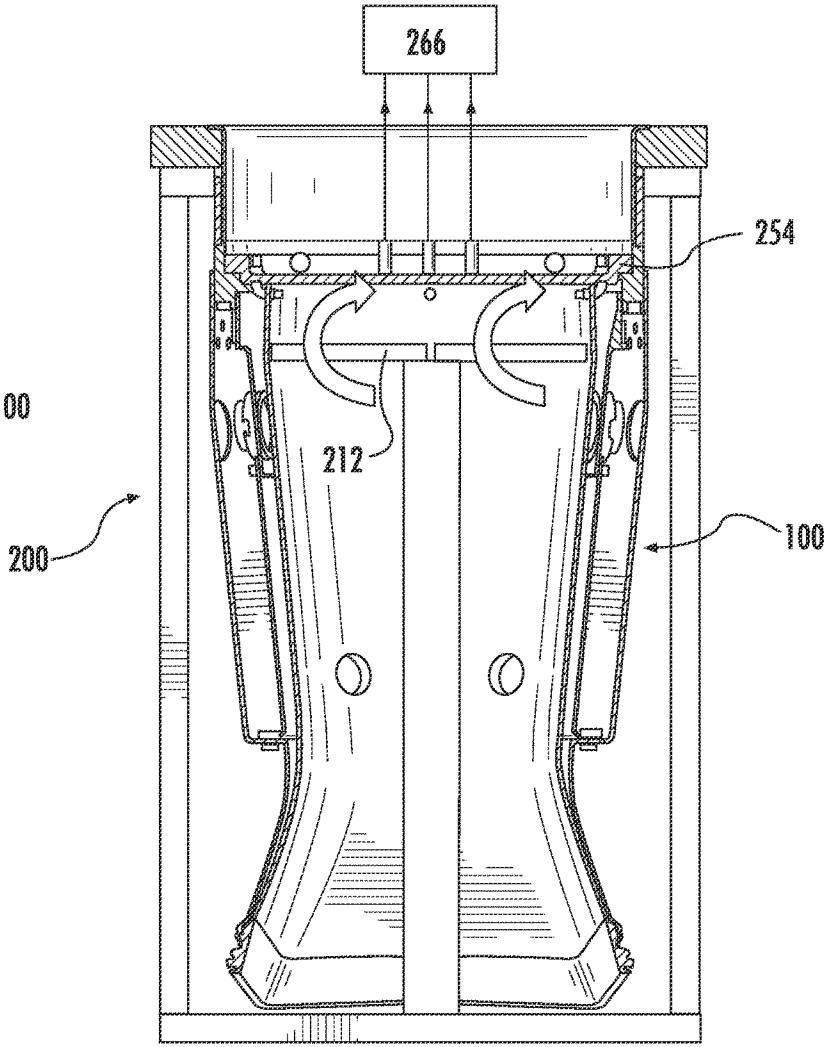
FIG. 22 is a cross sectional front view of the support frame shown and the assembled combustion module as shown in FIG. 21, according to at least one embodiment of the present invention.

In particular embodiments, the support frame 200 is used to assemble the combustion module 100. Once assembled, fully or partially, the support frame 200 may be used to transport and or store the combustion module 100. FIGS. 7 through 20 illustrate various steps for assembling the combustion module 100 using the support frame 200, and FIGS. 21 and 22 illustrate various steps for removing the assembled combustion module 100 from the support frame 200. The various steps of the method as described herein may be carried out in any order which allows assembly of the combustion module 100 using the support frame 200.

Figure 8:
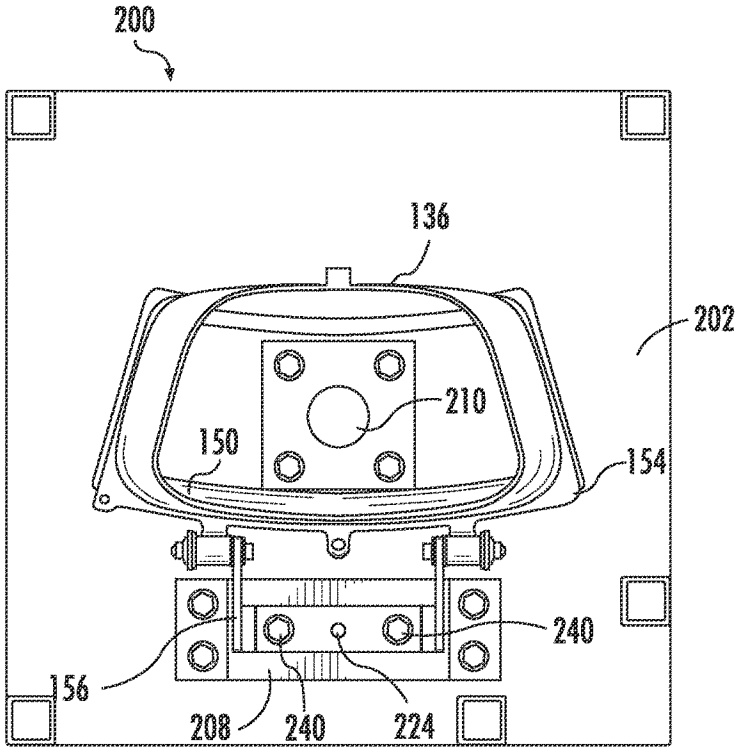
FIG. 8 is a cross sectional top view of the support frame and the portion of the combustion module shown in FIG. 7, according to at least one embodiment of the present invention.
Figure 7:
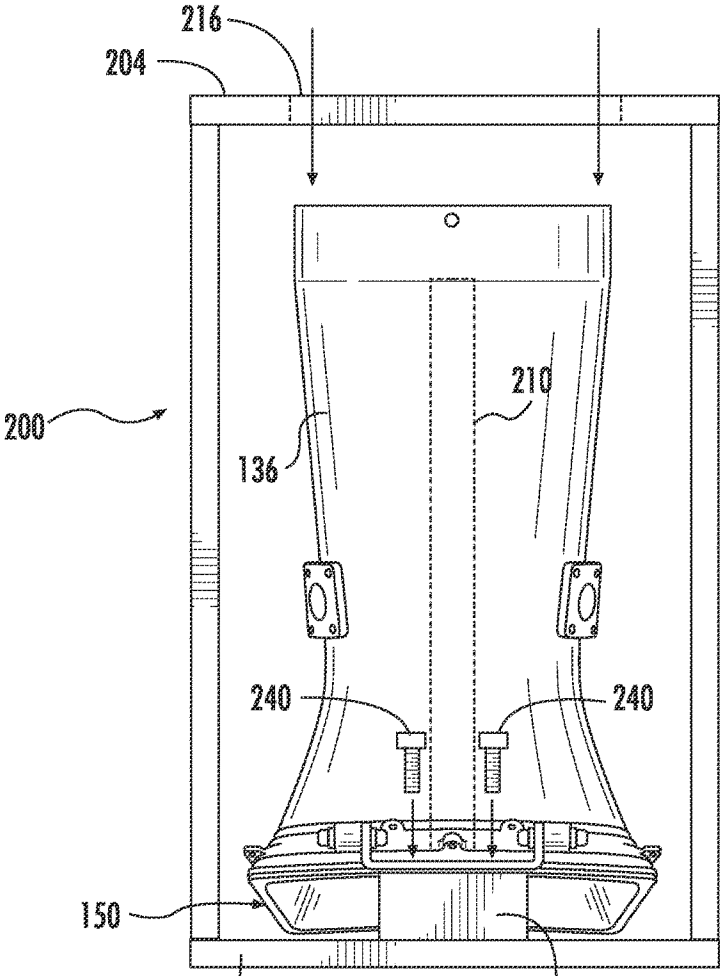
FIG. 7 is a front view of the support frame shown in FIG. 4 and a portion of the combustion module shown in FIG. 3, according to at least one embodiment of the present invention.

FIG. 7 provides a front view of the support frame 100 and the combustion liner 136 and FIG. 8 provides a cross sectional top view of the support frame 200 and the combustion liner 136. As shown in FIG. 7, the method includes inserting the combustion liner 136 through the opening 216 of the support plate 204 and guiding the combustion liner 136 over the central support column 210. The method further includes connecting the aft end 150 of the combustion liner 136 to the support block 208. The aft end 150 of the combustion liner 136 may be connected to the support block 208 using any mechanical fastener 240 such as a bolt and/or a nut that is suitable to support the combustion liner 136 during assembly and/or transportation of the combustion module 100. In particular embodiments, as shown in FIG. 8, the step of connecting the aft end 150 of the combustion liner 136 to the support block 208 includes connecting at least one of the aft frame 154 or the mounting bracket 156 to the support block 208. The method may further include aligning the aft end 150 of the combustion liner 136 to the support block 208 using the alignment feature 224 of the support block 208.

Figure 10:
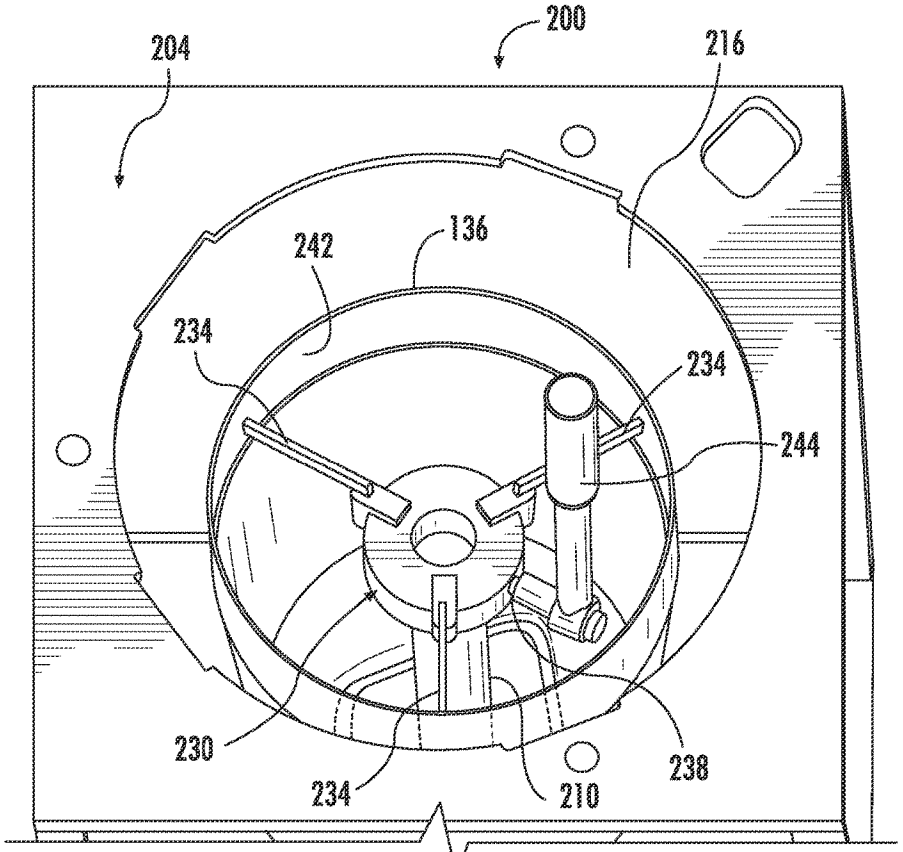
FIG. 10 is a top perspective view of a portion of the support frame and a portion of the combustion module as shown in FIG. 9, according to at least one embodiment of the present invention.
Figure 9:
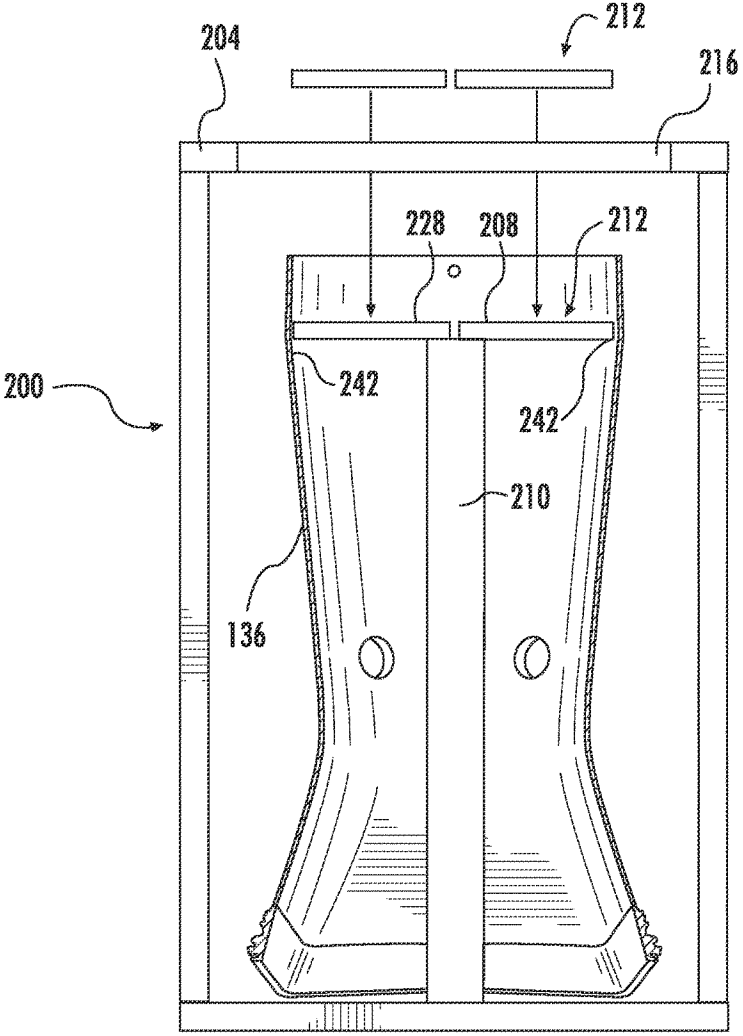
FIG. 9 is a cross sectional front view of the support frame and a portion of the combustion module as shown in FIG. 7, according to at least one embodiment of the present invention.

FIG. 9 provides a cross sectional front view of the support frame and the combustion liner 136 as shown in FIG. 7. As shown in FIG. 9, the method may further include aligning the combustion liner 136 to the opening 216 in the support plate 204. In particular embodiments, the step of aligning the combustion liner 136 to the opening 216 in the support plate 204 includes inserting the horizontal support 212 into the combustion liner 136 and coupling the horizontal support 212 to the central support column 210. In particular embodiments, the step of aligning the combustion liner 136 to the opening 216 in the support plate 204 further includes engaging the support arms 228 and/or the spokes 234 with an inner surface 242 of the combustion liner 136. FIG. 10 provides a top perspective view of the support frame 200 and the combustion liner 136. As shown in FIG. 10, the step of aligning the combustion liner 136 to the opening 216 in the support plate 204 may further include engaging or turning the actuator interface 238 of the hub and spoke assembly 230 to actuate the spokes 234 so as to engage the spokes 234 with the inner surface 242 of the combustion liner 136. As shown, the actuator interface may be engaged using a tool 244 such as a wrench or ratchet.

Figure 11:
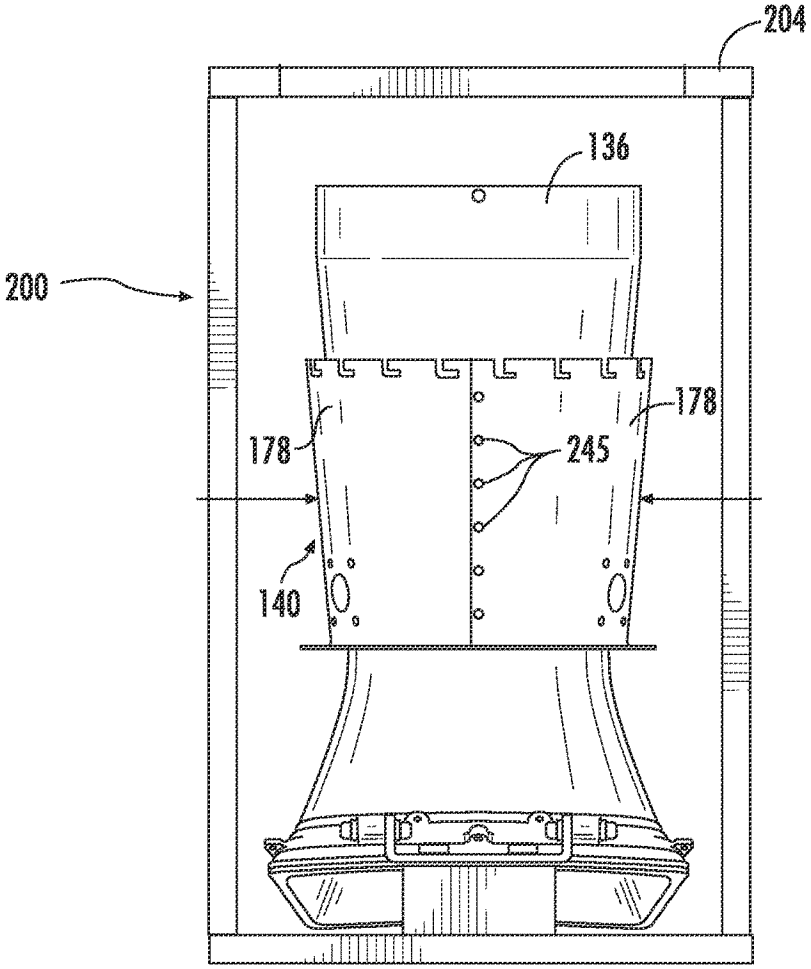
FIG. 11 is a front view of the support frame shown in FIG. 4 and a portion of the combustion module shown in FIG. 3, according to at least one embodiment of the present invention.

FIG. 11 provides a front view of the support frame 200, the combustion liner 136 and the flow sleeve 140. As shown in FIG. 11, the method further includes installing the flow sleeve 140 around a portion of the combustion liner 136. In a particular embodiment, installing the flow sleeve 140 includes wrapping the two or more semi-annular flow sleeve sections 178 around the combustion liner 136 and coupling the two or more semi-annular flow sleeve sections 178 together. The two or more semi-annular flow sleeve sections 178 may be coupled together or joined by any mechanical means suitable for the operating environment of the combustor 24. For example, the two or more semi-annular flow sleeve sections 178 may be coupled with mechanical fasteners 245 and/or by welding.

Figure 12:
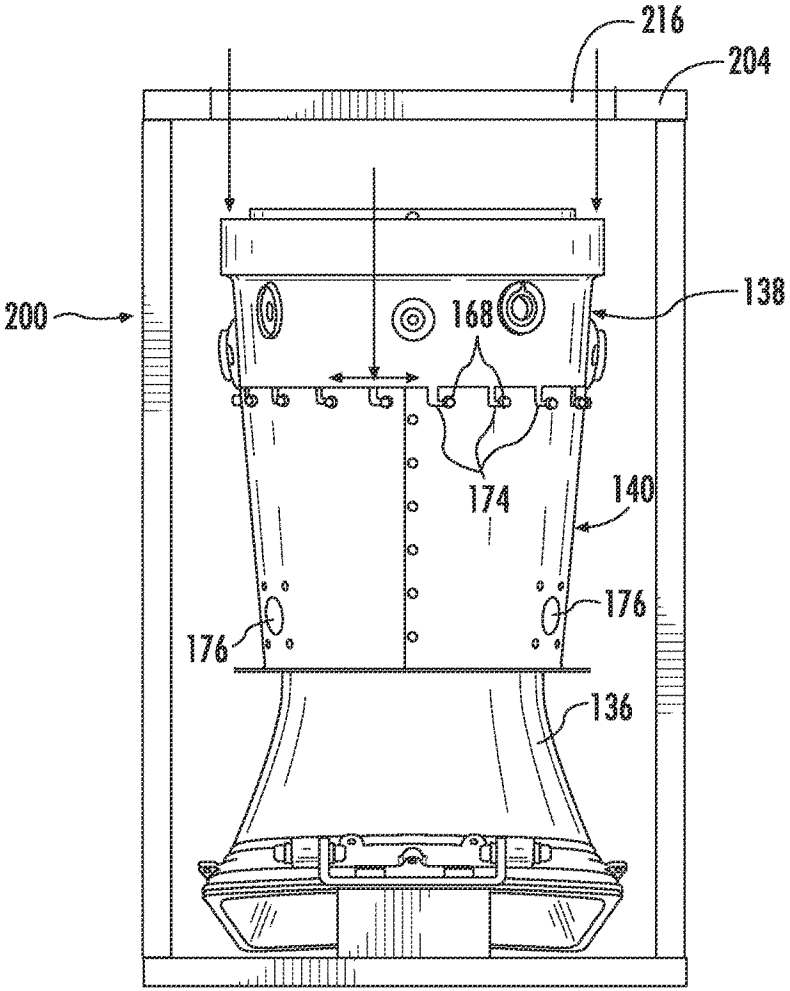
FIG. 12 is a front view of the support frame shown in FIG. 4 and a portion of the combustion module shown in FIG. 3, according to at least one embodiment of the present invention.

FIG. 12 provides a front view of the support frame 200, the combustion liner 136, the flow sleeve 140 and the support sleeve 138. As shown in FIG. 12, the method may further include connecting the support sleeve 138 to the flow sleeve 140. Connecting the support sleeve 138 to the flow sleeve 140 may include inserting the fastening features 168 of the support sleeve 138 into the locking channels 174 of the flow sleeve 140 and rotating or clocking the support sleeve 138 to engage the fastening features 168 with the locking channels 174. The support sleeve 138 may be lowered into position through the opening 216 in the support plate 204. Each of the plurality of fastening features 168 are aligned with a corresponding one of the plurality of locking channels 174.

Figure 13:
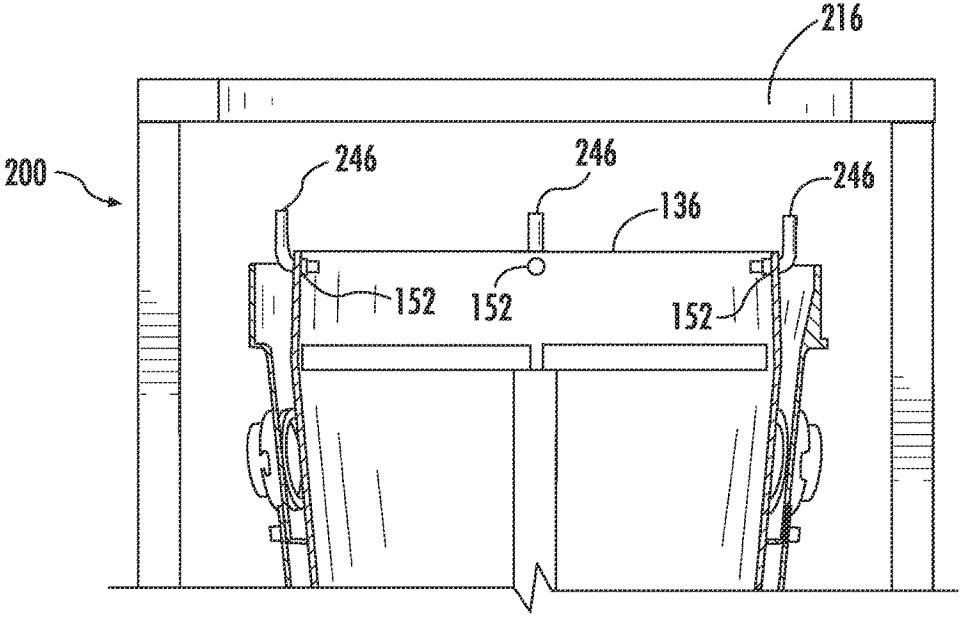
FIG. 13 is a cross sectional front view of a portion of the support frame and a portion of the combustion module as shown in FIG. 12, according to at least one embodiment of the present invention.

FIG. 13 provides a cross sectional front view of a portion of the support frame 200 including a portion of the combustion liner 136. As shown in FIG. 13, the method may further include inserting a plurality of fasteners 246 such as anchor bolts or shear pins through a corresponding one of the radially extending anchor passages 152. Each of the fasteners 246 may be fastened to the combustion liner 136 using any known mechanical fastener such as a nut that is suitable to support the combustion liner 136 during assembly, storage and/or transportation of the combustion module 100.

Figure 14:
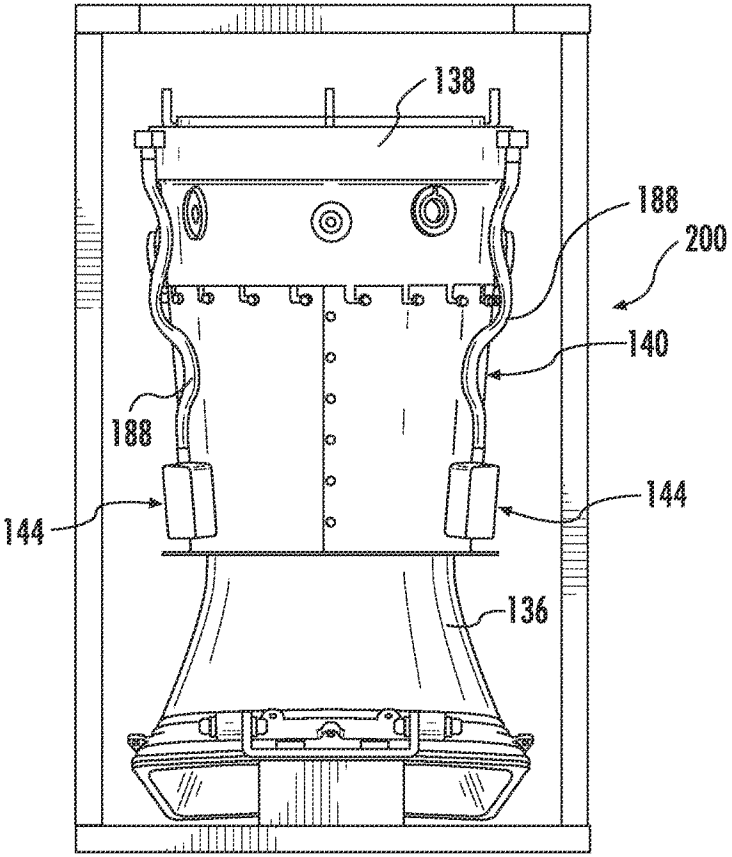
FIG. 14 is a front view of the support frame shown in FIG. 4 and a portion of the combustion module shown in FIG. 3, according to at least one embodiment of the present invention.

FIG. 14 provides a front view of the support frame 200 including the flow sleeve 140 and two of the one or more fuel injectors 144. As shown in FIG. 14, the method may further include inserting each of the one or more fuel injector(s) 144 through a corresponding fuel injector passage 176, as shown in FIG. 12, and connecting the fuel injectors 144 to at least one of the flow sleeve 140 or the combustion liner 136. The fuel injector(s) 144 may be coupled to the flow sleeve 140 and/or the combustion liner 136 using any mechanical fastener known in the art suitable for operating environment of the combustor 24 such as a bolt. Each of the fuel injectors 144 may include a corresponding fluid conduit 188.

Figure 16:
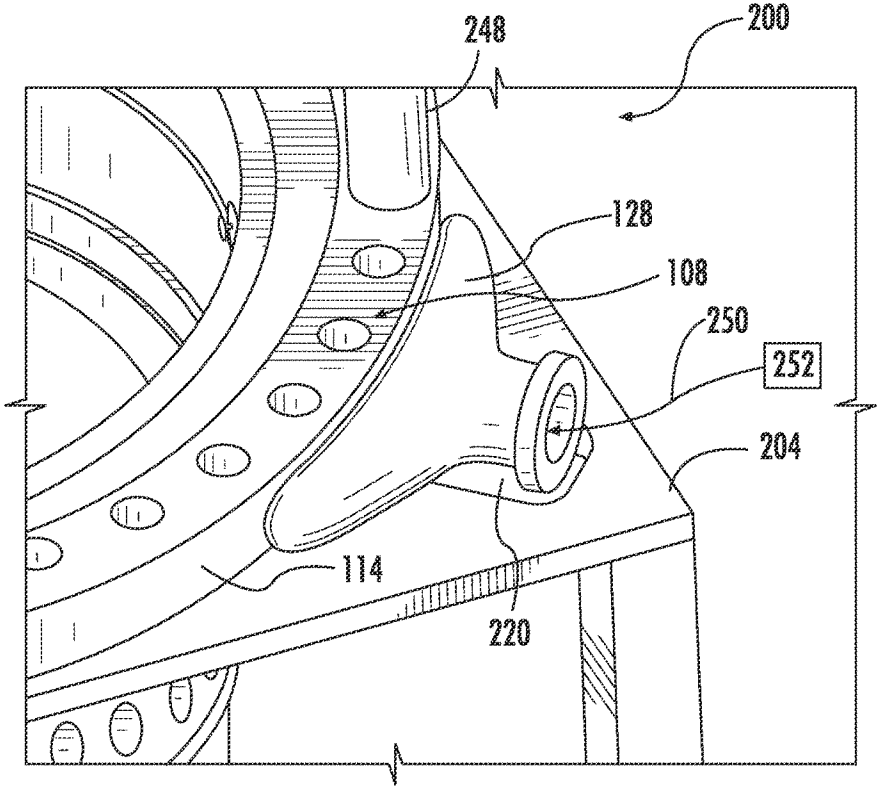
FIG. 16 is a top perspective view of a portion of the support frame and a portion of the combustion module as shown in FIG. 15, according to at least one embodiment of the present invention.
Figure 15:
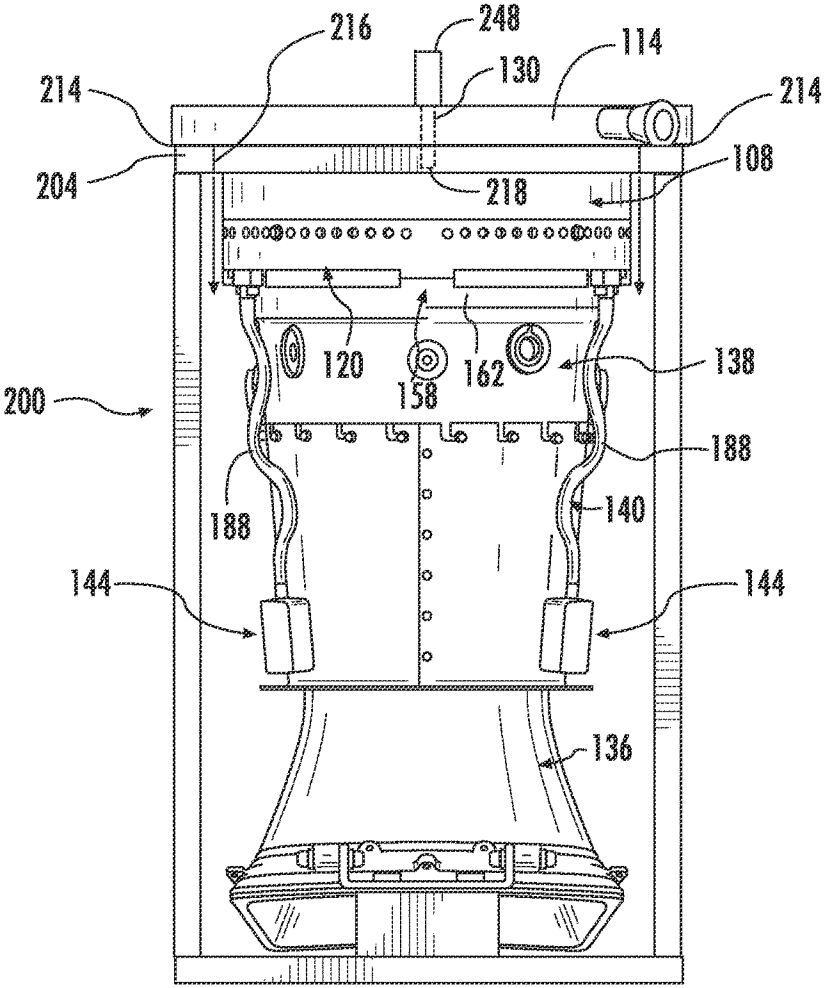
FIG. 15 is a front view of the support frame shown in FIG. 4 and a portion of the combustion module shown in FIG. 3, according to at least one embodiment of the present invention.

FIG. 15 provides a front view of the support frame 200 including the combustion liner 136, the flow sleeve 140, the support sleeve 138 and the fuel distribution manifold 108, and FIG. 16 provides a top perspective view of a portion of the support frame 200 and the fuel distribution manifold 108. As shown in FIG. 15, the method may further include inserting the fuel distribution manifold 108 through the opening 216 in the support plate 204 such that the mounting flange 114 of the fuel distribution manifold 108 rests on or is in contact with the outer surface 214 of the support plate 204 and the aft end 120 of the fuel distribution manifold 108 circumferentially surrounds the forward portion 158 of the support sleeve 138. For example, the aft end 120 of the fuel distribution manifold 108 may at least partially circumferentially surround the flange 162 of the support sleeve 138. The method may further include securing the mounting flange 114 to the support plate 204 using at least one fastener 248 such as a bolt or retaining pin that is inserted through the fastener holes 130 of the mounting flange 114 and into the at least one fastener hole(s) 218 of the support plate 204. The method may further include coupling each of the fluid conduits 188 to the fuel distribution manifold 108 via the one or more fuel connector ports 132 (FIG. 3).

As shown in FIG. 16, the method may further include aligning the inlet port 128 of the fuel distribution manifold 108 with the inlet port recess 220 of the support plate 204 to allow for assembly clearance and or access to the inlet port 128 during assembly. The method further include charging the fuel distribution manifold 108 with a gas 250 from a gas source 252 and testing for fluid/gas leaks between the fuel distribution manifold 108 and each of the plurality of the fuel injectors 144 (FIG. 15).

Figure 18:
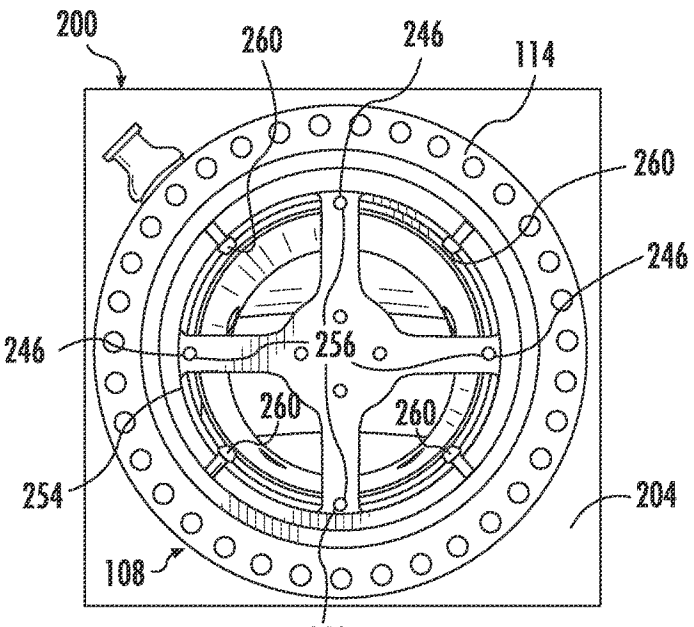
FIG. 18 is a top view of a portion of the support frame and a portion of the combustion module as shown in FIG. 17, according to at least one embodiment of the present disclosure.
Figure 17:
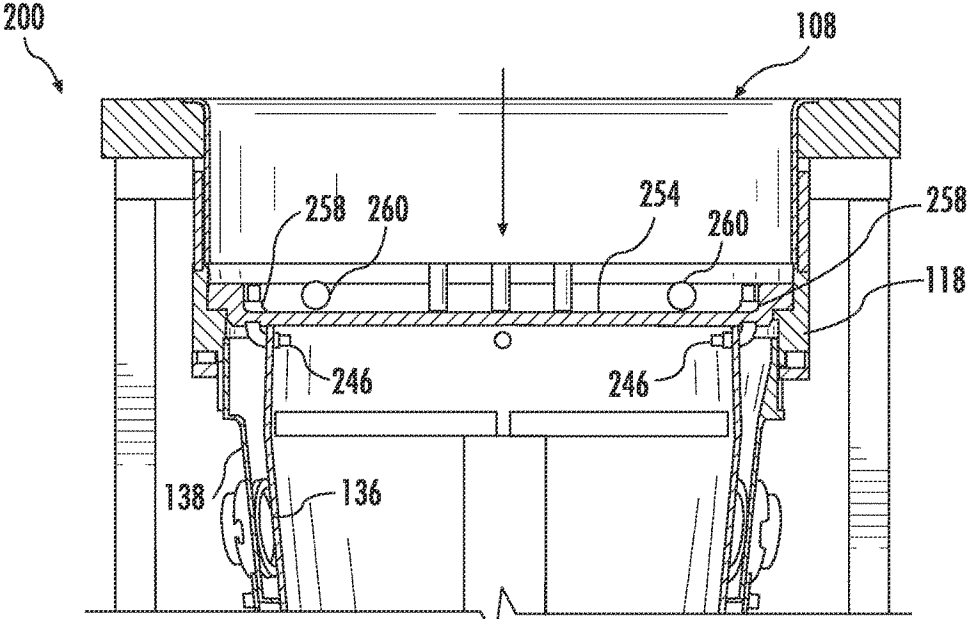
FIG. 17 is a cross sectional front view of a portion of the support frame shown in FIG. 4 and a portion of the combustion module shown in FIG. 3, according to at least one embodiment of the present invention.

FIG. 17 provides a cross section front view of a portion of the support frame 200 including a portion of the combustion liner 136, a portion of the support sleeve 138 and a portion of the fuel distribution manifold 108, and FIG. 18 provides a top view of the support frame 200 as shown in FIG. 17. As shown in FIGS. 17 and 18, the method may further include inserting a module support plate 254 into the fuel distribution manifold 108 such that at least some of the plurality of fasteners 246 extends vertically through a plurality of fastener openings 256 (FIG. 18) defined in the module support plate 254. The method further includes connecting the combustion liner 136 and the fuel distribution manifold 108 to the module support plate 254. The combustion liner 136 may be secured to the module support plate 254 via the fasteners 246 and/or a plurality of mechanical fasteners 258 such as nuts that couple to the fasteners 246. The fuel distribution manifold 108 may be secured to the module support plate 254 via bolts or pins 260 that extend radially and/or axially through the module support plate 254 and the fuel distribution manifold 108. In one embodiment, the bolts or pins 260 extend radially through the module support plate 254 and a corresponding one of the plurality of air injection passages 134 (FIG. 3) of the support ring 118 (FIGS. 3 and 17). The module support plate 254 generally provides a ridged connection between the fuel distribution manifold 108 and the fuel injection assembly 110 to support the combustion module 100 during installation. In alternate embodiments, the module support plate may extend at least partially within the liner 138 and/or may wrap at least partially around the mounting flange 114.

Figure 19:
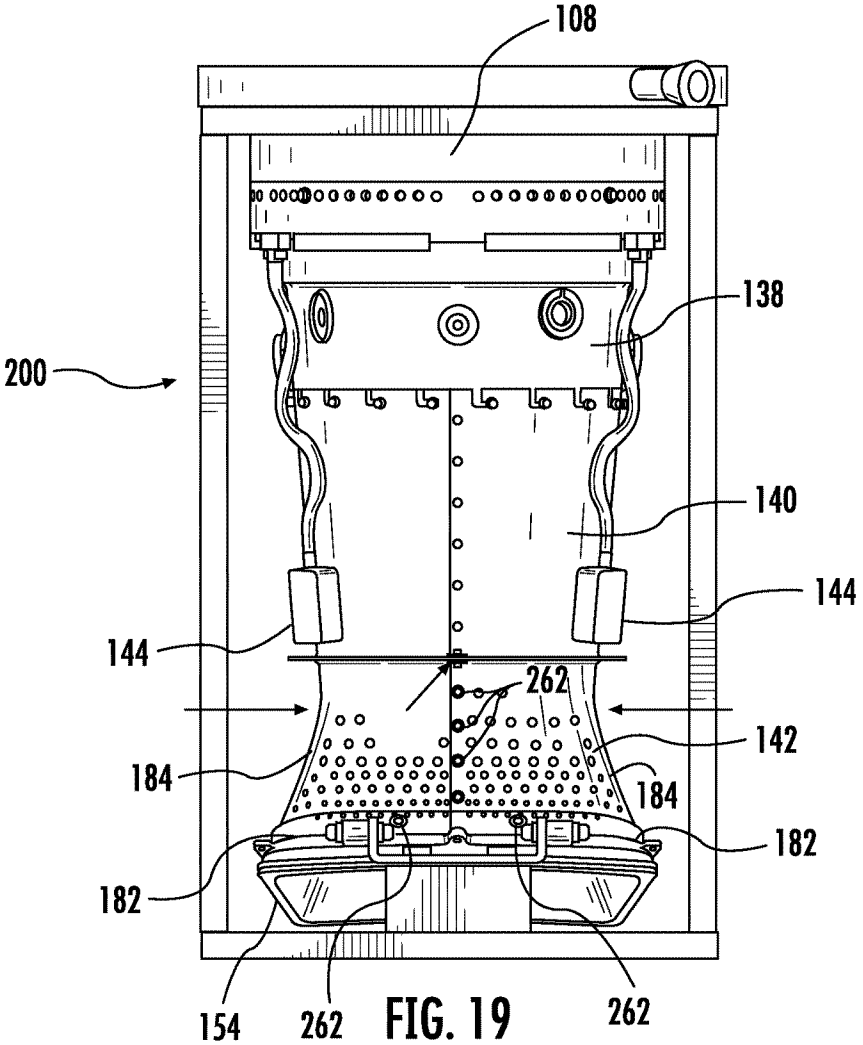
FIG. 19 is a front view of the support frame shown in FIG. 4 and a portion of the combustion module shown in FIG. 3, according to at least one embodiment of the present invention.

FIG. 19 provides a front view of the support frame 200 including the fuel distribution manifold 108, the support sleeve 138, the flow sleeve 140, the fuel injectors 144 and the impingement sleeve 142. As shown in FIG. 19, the method may further include installing the impingement sleeve 142 around a portion of the combustion liner 136. The method may further include connecting the aft end 182 of the impingement sleeve 142 to the aft frame 154. In one embodiment, installing the impingement sleeve 142 includes coupling the two or more semi-annular impingement sleeve sections 184 together around the combustion liner 136. The two or more semi-annular impingement sleeve sections 184 may be coupled together or joined by any mechanical means suitable for the operating environment of the combustor 24. For example, the two or more semi-annular impingement sleeve sections 184 may be coupled with mechanical fasteners 262 and/or by welding.

Figure 20:
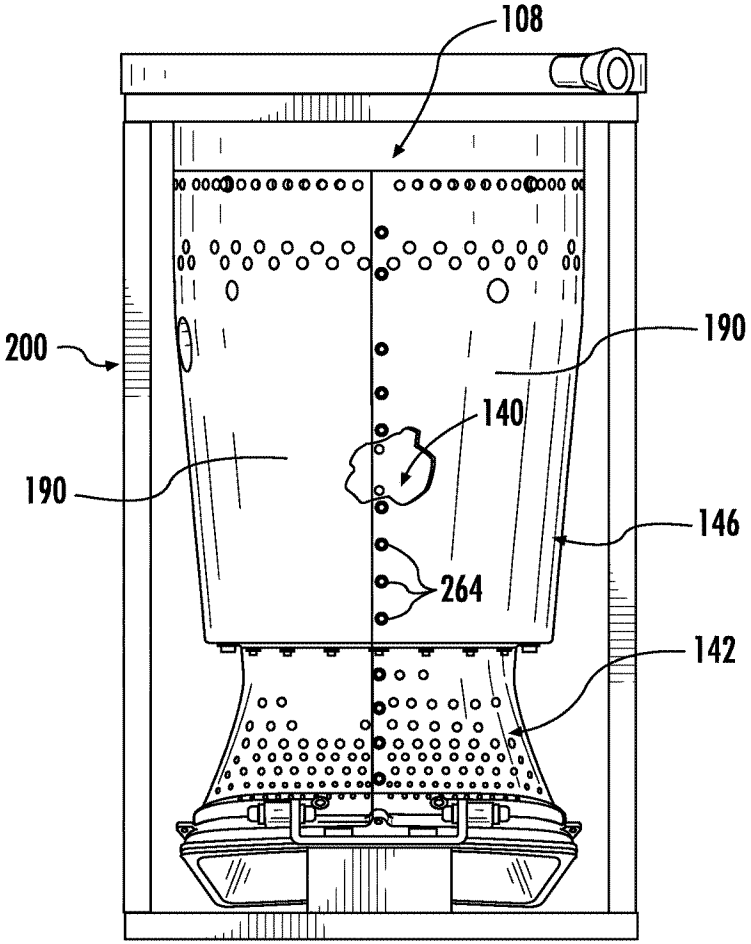
FIG. 20 is a front view of the support frame shown in FIG. 4 and the assembled combustion module shown in FIG. 3, according to at least one embodiment of the present invention.
Figure 21:
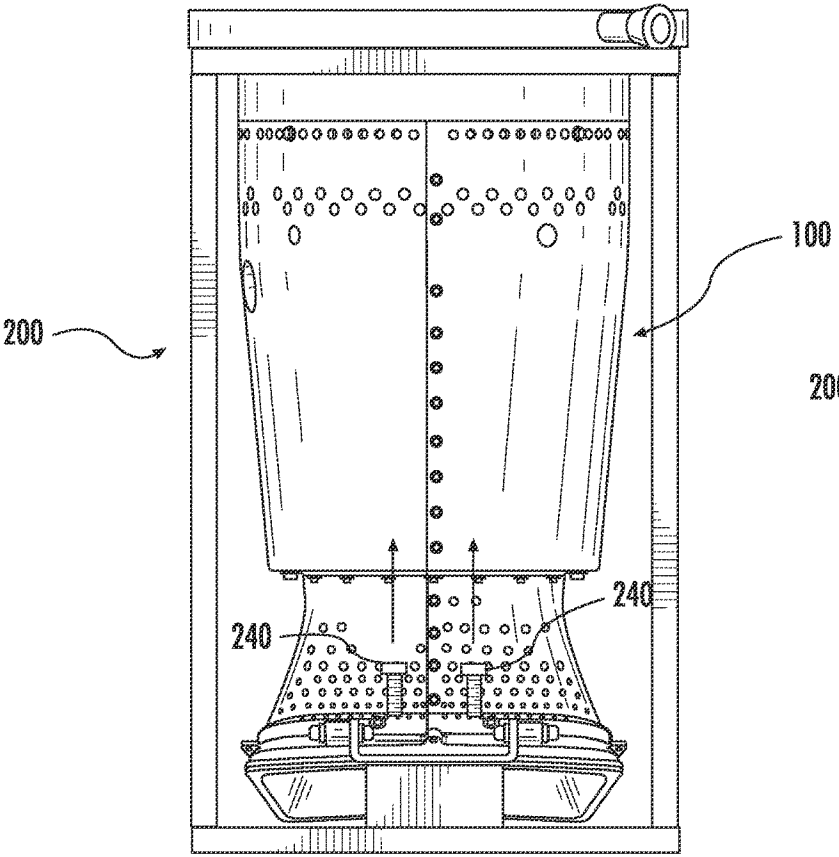
FIG. 21 is a front view of the support frame shown in FIG. 4 and the assembled combustion module shown in FIG. 3, according to at least one embodiment of the present invention.

FIG. 20 provides a front view of the support frame 200 including the fuel distribution manifold 108, the flow sleeve 140, the impingement sleeve 142 and the outer flow sleeve 146. As shown in FIG. 20, the method may further include installing the outer flow sleeve 146 around at least a portion of the flow sleeve 140. In one embodiment, installing the outer flow sleeve 146 includes wrapping the two or more semi-annular air shield sections 190 around the flow sleeve 140 and coupling the two or more semi-annular flow air shield sections 190 together. The two or more semi-annular air shield sections 190 may be coupled together or joined by any mechanical means suitable for the operating environment of the combustor 24. For example, the two or more semi-annular air shield sections 190 may be coupled with mechanical fasteners 264 and/or by welding.

FIG. 21 provides a front view of the support frame 200 including the assembled combustion module 100, and FIG. 22 provides a cross sectional view of the support frame 200 and the assembled combustion module 100 as shown in FIG. 21. As shown in FIGS. 21 and 22, once the combustion module 100 has been assembled and checked for leaks, the method may further comprise removing the combustion module 200 from the support frame 200. In one embodiment, the method includes removing the fasteners 240 from the support block 208. The method may further include retracting and/or removing the horizontal support 212 (FIG. 22). The method may further include coupling a lifting device 266 such as a crane to the module support plate 254. Finally, the method may include extracting the combustion module 100 out of the support frame 200.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A combustion module for a gas turbine, comprising:

an annular fuel distribution manifold having a forward end axially separated from an aft end and a radially extending mounting flange that circumferentially surrounds the forward end;

a fuel injection assembly that extends downstream from the annular fuel distribution manifold, the fuel injection assembly having a forward end axially separated from an aft end, a combustion liner that extends from the aft end of the annular fuel distribution manifold towards the aft end of the fuel injection assembly, a flow sleeve that circumferentially surrounds a portion of the combustion liner, a fuel injector that extends radially through the flow sleeve and the combustion liner, a fluid conduit that extends between the fuel injector and the annular fuel distribution manifold and an aft frame disposed at an aft end of the fuel injection assembly;

a support frame having a base plate, a support plate, a plurality of vertical support members that extends from the base plate to the support plate and a support block that extends vertically from the base plate towards the support plate, the support plate having an opening that extends vertically through the support plate, wherein each vertical support member is coupled to the base plate and to the support plate, wherein the plurality of vertical support members are circumferentially spaced around the opening of the support plate;

wherein the fuel distribution manifold extends through the opening of the support plate, the mounting flange being in contact with the support plate and the aft frame being removably coupled to the support block and wherein the support block is fixed to the base plate such that, during assembly, movement of the aft frame is restricted by the support block; and wherein the annular fuel distribution manifold, the combustion liner and the flow sleeve are held together as a combustion module assembly by the support frame.

2. The combustion module as in claim 1, wherein the support frame further comprises a central support column that extends from the base plate towards the support plate, the central support column extending at least partially through the combustion liner.

3. The combustion module as in claim 2, wherein the support frame further comprises a horizontal support disposed adjacent to a top end of the central support column, the horizontal support extending radially outwardly from the central support column towards an inner surface of the combustion liner so as to coaxially align the combustion liner with the opening in the support plate.

4. The combustion module as in claim 3, wherein the horizontal support comprises a hub and spoke assembly comprising a hub and a plurality of spokes coupled to the hub, the plurality of spokes being configured to rotate between a fully extended position for aligning the combustion liner with the opening in the support plate and a fully retracted position to allow for extraction of the combustion module from the support frame.

5. The combustion module as in claim 1, further comprising a module support plate that extends radially and circumferentially within the combustion module, wherein the module support plate is rigidly connected to the combustion liner and the fuel distribution manifold.

6. A method for assembling a combustion module within a support frame, wherein the combustion module comprises:

an annular fuel distribution manifold having a forward end axially separated from an aft end and a radially extending mounting flange that circumferentially surrounds the forward end; and a fuel injection assembly that extends downstream from the fuel distribution manifold, the fuel injection assembly having a forward end axially separated from an aft end, a combustion liner that extends from the aft end of the annular fuel distribution manifold towards the aft end of the fuel infection assembly, an annular flow sleeve that circumferentially surrounds a portion of the combustion liner, a fuel injector that extends radially through the annular flow sleeve and the combustion liner, a fluid conduit that extends between the fuel injector and the fuel distribution manifold and an aft frame disposed at the aft end of the fuel injection assembly;

wherein the support frame comprises:

a base plate, a support plate, a plurality of vertical support members that extends from the base plate to the support plate and a support block that extends vertically from the base plate towards the support plate, the support plate having an opening that extends vertically through the support plate, wherein each vertical support member is coupled to the base plate and to the support plate, wherein the plurality of vertical support members are circumferentially spaced around the opening of the support plate;

wherein the annular fuel distribution manifold extends through the opening of the support plate, the mounting flange being in contact with the support plate and the aft frame being removably coupled to the support block and wherein the support block is fixed to the base plate such that, during assembly, movement of the aft frame is restricted by the support block; and wherein the annular fuel distribution manifold, the combustion liner and the annular flow sleeve are held together as a combustion module assembly by the support frame; and wherein the method comprises:

positioning the combustion liner of the combustion module over a central support column of the support frame and fastening an aft end of the combustion liner to the support block of the support frame;

installing the annular flow sleeve around the portion of the combustion liner;

inserting a first plurality of fasteners through a plurality of anchor passages disposed proximate to a forward end of the combustion liner;

inserting the annular fuel distribution manifold through the opening in the support plate of the support frame such that the aft end of the annular fuel distribution manifold circumferentially surrounds a forward portion of the annular flow sleeve;

connecting the mounting flange of the annular fuel distribution manifold to the support plate; and connecting a module support plate to the combustion liner and to the annular fuel distribution manifold using the first plurality of fasteners to connect the combustion liner to the module support plate and a second plurality of fasteners to connect the fuel distribution manifold to the module support plate.

7. The method as in claim 6, further comprising coaxially aligning the combustion liner to the opening in the support plate using a horizontal support, wherein the horizontal support is attached to the central support column.

8. The method as in claim 6, wherein installing the annular flow sleeve around the portion of the combustion liner comprises coupling two or more semi-annular flow sleeve sections together around the combustion liner and coupling the two or more semi-annular flow sleeve sections to an annular support sleeve.

9. The method as in claim 6, further comprising installing an annular impingement sleeve around the portion of the combustion liner.

10. The method as in claim 9, wherein said step of installing the annular impingement sleeve comprises coupling two or more semi-annular impingement sleeve sections together around the combustion liner and coupling the two or more semi-annular impingement sleeve sections to the aft frame.

11. The method as in claim 6, further comprising inserting the fuel injector through a corresponding fuel injector passage and connecting the fuel injector to at least one of the annular flow sleeve or the combustion liner.

12. The method as in claim 11, further comprising fluidly connecting the fuel injector to the annular fuel distribution manifold.

13. The method as in claim 12, further comprising charging the annular fuel distribution manifold with a gas or air and testing for fluid leaks between the annular fuel distribution manifold and the fuel injector.

14. The method as in claim 6, further comprising installing an annular outer sleeve around the forward portion of the annular flow sleeve.

15. The method as in claim 6, further comprising coupling a lifting device to the module support plate and extracting the combustion module from the support frame.

* * * * *